US009701108B2

(12) United States Patent
Fujiwara et al.

(10) Patent No.: US 9,701,108 B2
(45) Date of Patent: Jul. 11, 2017

(54) PRINTING PLATE HOLDING APPARATUS

(71) Applicants: Reishi Fujiwara, Narashino (JP); Hitoshi Tomaki, Daisen (JP); Kazumi Odashima, Daisen (JP)

(72) Inventors: Reishi Fujiwara, Narashino (JP); Hitoshi Tomaki, Daisen (JP); Kazumi Odashima, Daisen (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 0 days.

(21) Appl. No.: 14/727,404

(22) Filed: Jun. 1, 2015

(65) Prior Publication Data

US 2016/0159078 A1 Jun. 9, 2016

(30) Foreign Application Priority Data

Dec. 5, 2014 (JP) ..... 2014-246965

(51) Int. Cl.
*B41F 27/12* (2006.01)
*B41F 27/10* (2006.01)

(52) U.S. Cl.
CPC ..... *B41F 27/10* (2013.01); *B41F 27/125* (2013.01); *B41F 27/1225* (2013.01); *B41F 27/1262* (2013.01); *B41F 27/12* (2013.01)

(58) Field of Classification Search
None
See application file for complete search history.

(56) References Cited

U.S. PATENT DOCUMENTS 2,965,025 A * 12/1960 Mueller ..... B41F 27/1225 101/415.1
3,408,933 A * 11/1968 Hermach ..... B41F 27/1262 101/415.1

(Continued)

FOREIGN PATENT DOCUMENTS

EP 257176 A2 3/1988
EP 1282518 A1 2/2003

(Continued)

OTHER PUBLICATIONS

Extended European Search Report dated Jan. 14, 2016, issued in counterpart European Application No. 15174786.2.

*Primary Examiner* — Jill Culler
(74) *Attorney, Agent, or Firm* — Holtz, Holtz & Volek PC

(57) ABSTRACT

A printing plate holding apparatus is provided which during a high speed printing operation reduces vibrations and noises caused in a groove for having a grip leading end and a grip trailing end of a printing plate inserted therein, which can fasten the printing plate with greater certainty, and which is suitable for the printing plate to be held securely on such as a sleeve cylinder whose weight reduction is demanded.

It is a printing plate holding apparatus in which a printing plate 5 wound on a plate cylinder 2 is to be held securely thereon in a rotary press, the apparatus having a plate insertion groove 4 formed on an outer peripheral surface of the plate cylinder 2 and extending axially of the plate cylinder 2 for receiving a grip leading end 5*a* and a grip trailing end 5*b* of the printing plate 2, and comprising a printing plate retainer plate 6 and a tap bolt 7 for bringing both widthwise lateral end portions of the grip leading and trailing ends 5*a* and 5*b* of the printing plate into overlapping each other in the plate insertion groove 2 and for pressing (Continued)

and fastening them against a constraint surface 4*b* with which the grip trailing end 5*b* is in contact, in the plate insertion groove 4.

4 Claims, 4 Drawing Sheets

(56) References Cited

U.S. PATENT DOCUMENTS

| | | | | | |
|---|---|---|---|---|---|
| 4,376,414 | A * | 3/1983 | Burger | B41F 27/1262 | 101/415.1 |
| 4,702,166 | A | 10/1987 | Depa | | |
| 5,375,520 | A * | 12/1994 | Kobler | B41F 27/1268 | 101/378 |
| 5,503,072 | A * | 4/1996 | Schneider | B41F 30/04 | 101/378 |
| 5,915,303 | A * | 6/1999 | Whiting | B41F 27/1262 | 101/415.1 |
| 7,487,725 | B2 * | 2/2009 | Koppelkamm | B41F 27/1237 | 101/378 |
| 9,021,950 | B2 | 5/2015 | Izawa et al. | | |
| 2003/0154873 | A1 | 8/2003 | Pezzetta et al. | | |

FOREIGN PATENT DOCUMENTS

| | | | |
|---|---|---|---|
| JP | 2002326341 | A | 11/2002 |
| JP | 2012166569 | A | 9/2012 |
| JP | 2014091301 | A | 5/2014 |
| WO | 0187612 | A1 | 11/2001 |

* cited by examiner

PRINTING PLATE HOLDING APPARATUS

TECHNICAL FIELD

The present invention relates to a printing plate holding apparatus whereby a printing plate wound on a plate cylinder is held securely thereon in a rotary press.

BACKGROUND ART

A sleeve cylinder exchangeable variable printer in which a printing images different in a vertical length are printed on a continuous web of paper is known from JP 2014-91301 A. Printing machines of this sort have been designed to exchange sleeve cylinders in a manual operation. Needs therefore arise to reduce the thickness of a sleeve cylinder as thin as possible in order to reduce its weight. The patent document mentioned above shows in FIGS. 4 and 5, and describes in connection therewith, an insertable printing plate which uses no plate clamping or winding bar but in which a grip leading end and a grip trailing end of the printing plate may be inserted simply in a groove on the sleeve cylinder for mounting the printing plate thereon.

This technique, however, in which the grip leading and trailing ends of a printing plate are inserted merely in a groove has been uncertain whether the printing plate is firmly held in position. While JP 2012-166569 A and JP 2002-326341 A show that press fitting members of metal, rubber, resin or leaf spring are added and press fitted into the groove for securing the printing plate, it has been difficult to ascertain that the press fitting members have been press fitted in a whole section in the width direction. Also, a need to increase the groove width by an amount of the thicknesses of such press fitting members has caused bounces (vibrations), noises and printing obstacles to occur in the groove while the plate cylinder is being rotated at high printing speed.

An object to be achieved of the present invention is to provide a printing plate holding apparatus which during a high speed printing operation reduces vibrations and noises caused in a groove for having a grip leading end and a grip trailing end of a printing plate inserted therein, which can fasten the printing plate with greater certainty, and which is suitable for a plate cylinder having such as a sleeve cylinder whose weight reduction is demanded.

DISCLOSURE OF THE INVENTION

In accordance with the present invention there is provided a printing plate holding apparatus in which a printing plate wound on a plate cylinder is held securely thereon in a rotary press, and which comprises: a plate insertion groove formed on an outer peripheral surface of the plate cylinder and extending axially of the plate cylinder for having a grip leading end and a grip trailing end of the printing plate inserted into the plate insertion groove; and a printing plate retainer plate and a tap bolt for bringing both widthwise lateral end portions of the grip leading and trailing ends of the printing plate into overlapping each other in the plate insertion groove and for pressing and fastening them against a constraint surface with which the grip trailing end is in contact in the plate insertion groove.

In a printing plate holding apparatus as set forth above, the plate cylinder may comprise a rotating shaft and a sleeve cylinder removably mounted on the rotating shaft so that it can be fitted on, and extracted from, the rotating shaft, and the plate insertion groove is formed on an outer peripheral surface of the sleeve cylinder.

Also, the plate insertion groove has a width that is a size in which 0.1 mm to 0.2 mm is added to a sum of plate thicknesses of the grip leading and trailing ends of the printing plate.

Further, the printing plate retainer plate is formed with a tapped hole passing therethrough and having a thread diameter identical to that of the tap bolt, and the tap bolt has a body under its head, the body having an outer diameter smaller than an inner diameter of the tapped hole in the printing plate retainer plate in an interval longer than a plate thickness of the printing plate retainer plate.

According to the present invention, since both widthwise lateral end portions of a printing plate fitted on a plate cylinder are securely held on the plate cylinder with a printing plate retainer plate, it is not necessary to increase the groove width by amount of thicknesses of such press fitting members described above, thereby providing a printing plate holding apparatus which during a high speed printing operation reduces bounces (vibrations) and noises caused in a groove for having a grip leading and a grip trailing end of a printing plate inserted therein, which can fasten the printing plate with greater certainty and which is suitable for the printing plate to be firmly held on such as a sleeve cylinder whose weight reduction is required.

BEST MODES FOR CARRYING OUT THE INVENTION

Figure 1:
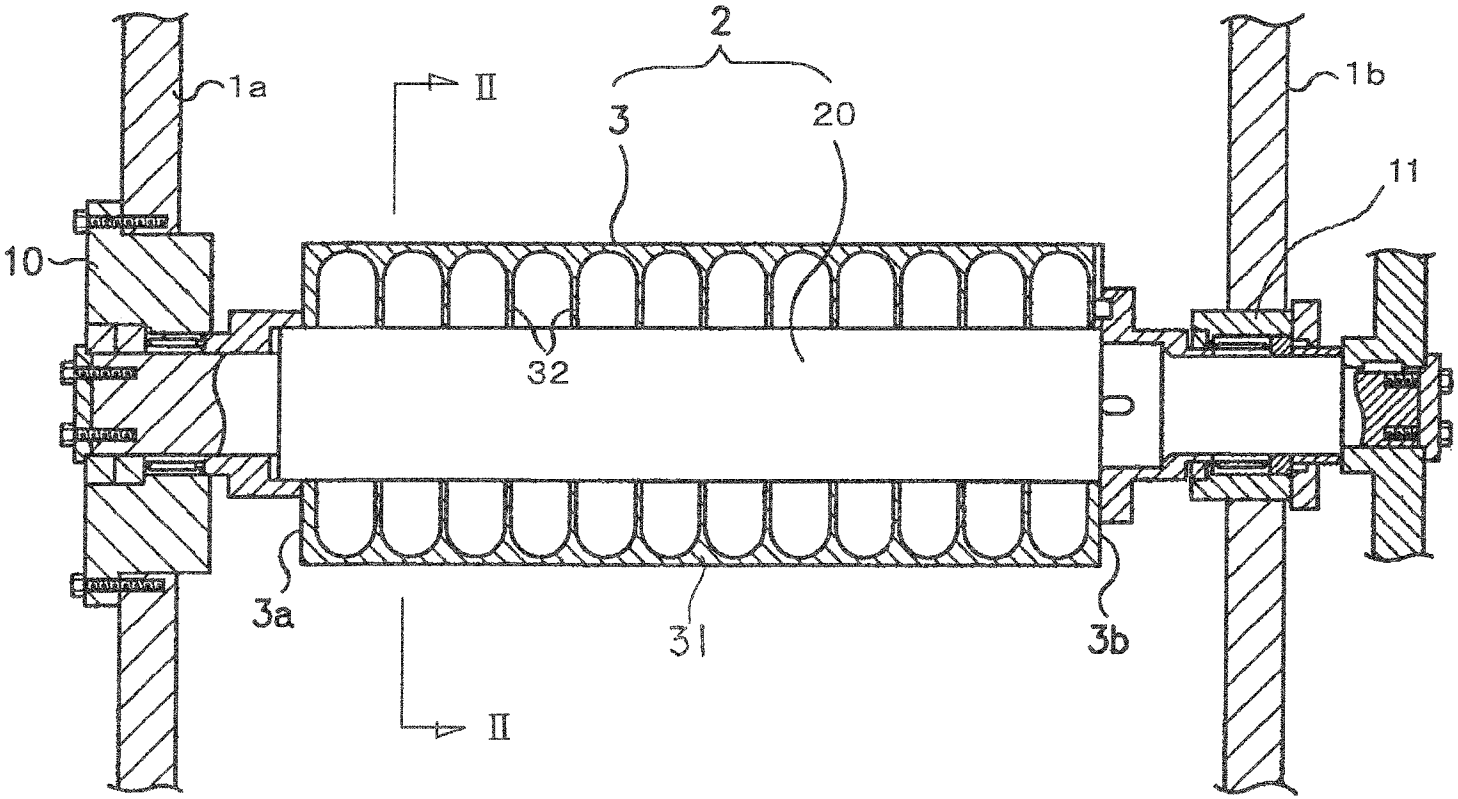
FIG. 1 is a sectional view illustrating a plate cylinder arrangement and a plate cylinder including a printing plate holding apparatus that constitutes an embodiment of the present invention.

FIG. 1 shows a plate cylinder 2. The plate cylinder 2 consists of a rotating shaft 20 rotatably supported by bearing members 10 and 11 mounted on main frames 1*a* and 1*b*, and of a sleeve cylinder 3. The sleeve cylinder 3 comprises a cylinder body 33 having a plurality of ribs 32 in the form of centrally opened annular disks formed on an inner peripheral surface of a cylinder body 31 and axially spaced apart from one another. The sleeve cylinder 3 is removably mounted on the rotating shaft 20 so that it can be fitted on, and extracted from, the rotating shaft 20.

Figure 2:
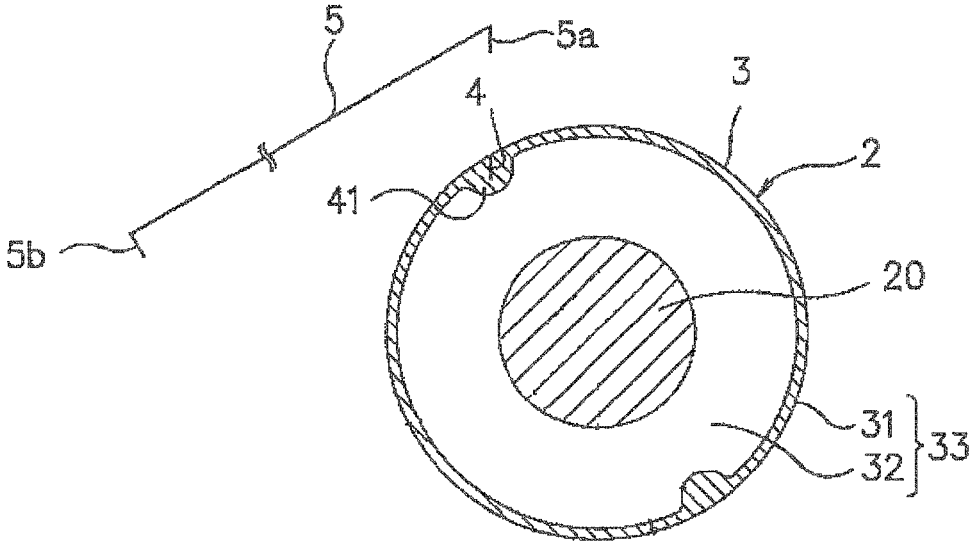
FIG. 2 is a cross sectional view of the plate cylinder of FIG. 1 taken along the line II-II.
Figure 3A:
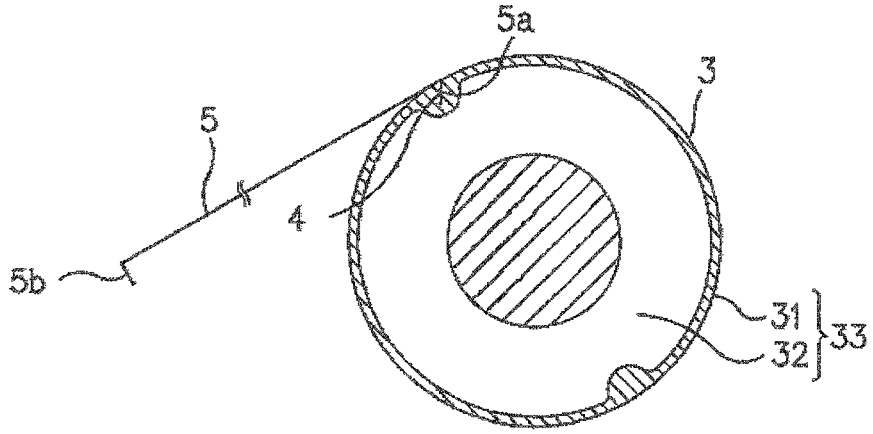
FIGS. 3A, 3B and 3C are explanatory views for illustrating an operation of mounting an insertable printing plate in the plate cylinder of FIG. 2.
Figure 3B:
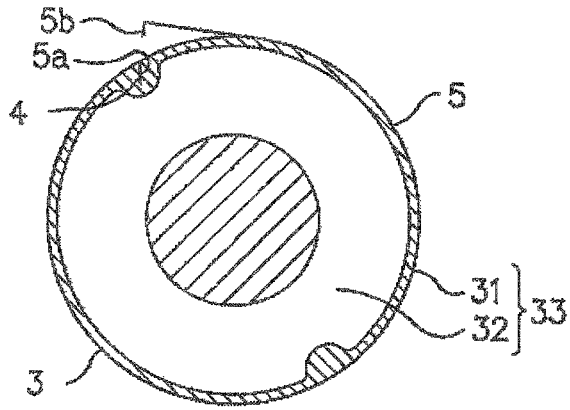
Figure 3C:
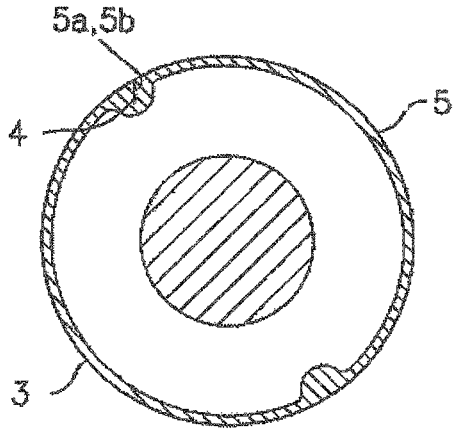

As shown in FIG. 2, the sleeve cylinder 3 (cylinder body 33) for the plate cylinder 2 is formed on its outer peripheral surface with a plate insertion groove 4 which extends axially and into which a grip leading end 5*a* and a grip trailing end 5*b* of an insertable printing plate 5 may be inserted. And, the grip leading end 5*a* of the insertable printing plate 5 is inserted into the plate insertion groove 4 as shown in FIG. 3A so that the printing plate 5 is wound onto the outer peripheral surface of the sleeve cylinder 3 as shown in FIG. 3B. And, as shown in FIG. 3C the grip trailing end 5*b* of the insertable printing plate 5 is inserted into the plate insertion groove 4 to attach the insertable printing plate 5 to the outer peripheral surface of the sleeve cylinder 3.

The plate insertion groove 4 needs to be of an adequate depth sufficient to accept an adequate length of the grip leading end 5*a* and the grip trailing end 5*b* of the insertable printing plate 5. As mentioned above, however, the sleeve cylinder 3 (cylindrical body 31) is made thin because of its weight reduction. The inner peripheral surface of the sleeve cylinder 3 (cylindrical body 31) is then formed with an axially continuous convex area 41 for grooving, which area is formed with the plate insertion groove 4 that is of a sufficient depth even though the sleeve cylinder 3 is made thin in wall thickness. In other words, the depth of the plate insertion groove 4 can be made larger than the wall thickness of the sleeve cylinder 3 (cylindrical body 31).

Figure 4A:
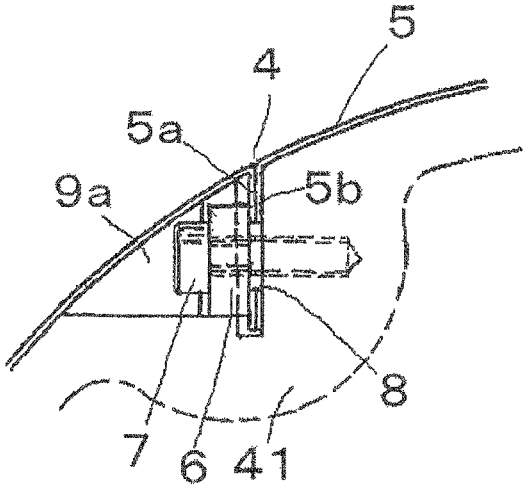
FIGS. 4A, 4B and 4C are explanatory views for illustrating an end face 3*a* of a sleeve cylinder having a plate insertion groove 4 in the printing plate holding apparatus.
Figure 4B:
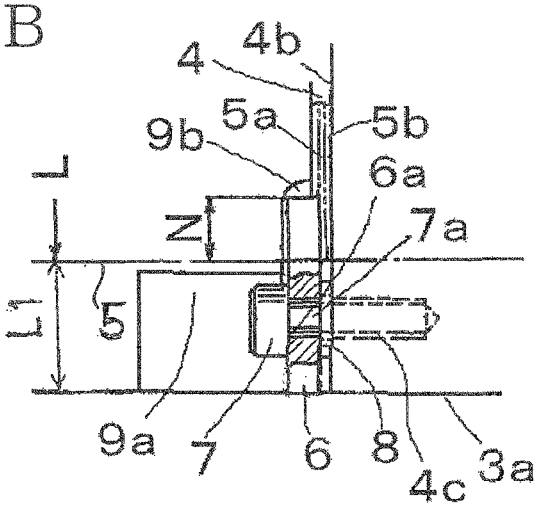
Figure 4C:
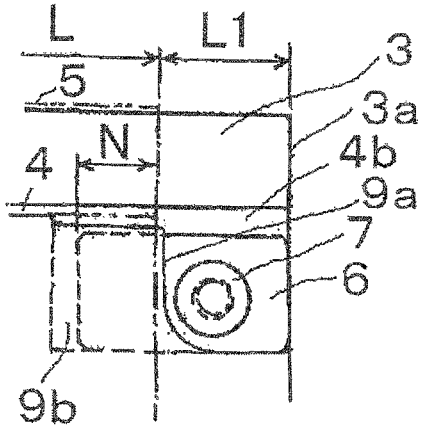

FIG. 4A is a front view illustrating an end face 3*a* of the sleeve cylinder 3, and FIG. 4B is a top plan view thereof, indicating the insertable printing plate 5 in a two dotted chain line. FIG. 4C is a left side view of the view of FIG. 4A. It is seen that the opposite end face 3*b* is likewise configured because of bilateral symmetry. It is shown that the insertable printing plate 5 of a width L is wound on the outer peripheral surface of the sleeve cylinder 3 as positioned at a distance L1 inwards from the end face 3*a* (3*b*) with its grip leading and trailing ends 5*a* and 5*b* inserted in the plate insertion groove 4.

As seen from FIG. 4B, the plate insertion groove 4 has a width in a circumferential direction of the sleeve cylinder 3 which is narrowed as much as a size in which 0.1 mm to 0.2 mm is added to a sum of thicknesses of the grip lending and trailing ends 5*a* and 5*b* of the insertable printing plate 5. Into the plate insertion groove 4 so narrowed, there are forcibly inserted the grip leading and trailing ends 5*a* and 5*b* bent diametrically and then slightly deformed circumferentially whereby portions of the deformation of the grip leading and trailing ends 5*a* and 5*b* are held against wall surfaces of the plate insertion groove 4, making them hard to come off the groove 4 while rendering it possible to reduce bounces (vibrations), noises and printing obstacles.

Also, as shown in FIG. 4B, both lateral end portions of the grip leading and trailing ends 5*a* and 5*b* of the insertable printing plate 5 which are brought into overlapping each other in the plate insertion groove 4 can be pressed and fastened together by a tap bolt 7 and a printing plate retainer plate 6 over a width N against a constraint surface 4*b* with which the grip trailing end 5*b* is in contact in the plate insertion groove 4. Hence, the grip leading and trailing ends 5*a* and 5*b* inserted into the plate insertion groove 4 if they may be loosened while the sleeve cylinder 3 is being rotated prevents the printing plate 5 from falling off. It should be noted further that the pressing force applicable to the printing plate retainer plate 6 can also be adjusted by increasing and decreasing the thickness of a shim 8 in the form of a washer interposed between the printing plate retainer plate 6 and the constraint surface 4*b* or by increasing or decreasing the tightening quantity of the tap bolt 7 without the shim 8.

It will be seen from FIG. 4C that continuously with both side ends of the plate insertion groove 4, the sleeve cylinder 3 is formed, for allowing the tap bolt 7 and the printing plate retainer plate 6 to be mounted on the constraint surface 4*b*, with a cutout 9*a* having a corner R larger than a head of the tap bolt 7 and with a cutout 9*b* parallel to the constraint surface 4*b*. A lateral end edge of the insertable printing plate 5 which is at a position spaced by the distance L1 from the end face 3*a* lies inwards of a vertical surface of the cutout 9*a*. This is because if the printing plate were above the cutout 9*a*, there is no peripheral surface of the sleeve cylinder 3 there, letting the printing pressure fall off not to allow printing there. Also, providing the cutout 9*a* may require lengthening the sleeve cylinder 3 axially by a necessary amount, this increasing the sleeve cylinder 3 in weight. Hence, to achieve a weight reduction of the sleeve cylinder 3 provided with a cutout 9*a*, it is desirable to minimize its width axially of the sleeve cylinder 3. As for the cutout 9*b* as shown in FIG. 4B, its face opposite to the constraint surface 4*b* in the plate insertion groove 4 is formed by cutting it to a width into which the printing plate retainer plate 6 is entered by a length more than N from the vertical surface of the cutout 9*a*, it is not necessary where the width of the plate insertion groove 4 in the circumferential direction of the sleeve cylinder 3 can be widened or where the printing plate retainer plate 6 can be made thin.

Further, the printing plate retainer plate 6 has a tapped hole 6*a* passing therethrough of which a thread diameter is identical to that of the tap bolt 7. The body 7*a* of the tap bolt 7 under its head has an outer diameter smaller than an inner diameter of the tapped hole 6*a* in an interval longer than the plate thickness of the printing plate retainer plate 6. In the structure described and in the state shown in FIG. 4B in which the tap bolt 7 is screwed into the tapped hole 6*a* of the plate retainer plate 6 and further screwed into a tapped hole 4*c* formed on the constraint surface 4*b*, the tap bolt 7 can be rotated freely and without constraint by the plate retainer plate 6, being capable of adjusting the pressing force of the printing plate retainer plate 6. In their parting direction, the thread of the tap bolt 7 interferes with the tapped hole 6*a* of the plate retainer plate 6 and the printing plate retainer plate 6 is restricted by a marginal part of the cutout 9*a*, thereby keeping the tap bolt 7 from coming off the sleeve cylinder 3.

What is claimed is:

1. A printing plate holding apparatus in which a printing plate that is able to be wound on a plate cylinder is held securely thereon in a rotary press, wherein the plate cylinder comprises a plate insertion groove which is formed on an outer peripheral surface of the plate cylinder, which extends axially of the plate cylinder, and which is adapted to have a grip leading end and a grip trailing end of the printing plate inserted into the plate insertion groove, and wherein the printing plate holding apparatus consists of:

a printing plate retainer plate and a tap bolt which are adapted to bring both widthwise lateral end portions of the grip leading and trailing ends of the printing plate into overlapping each other in said plate insertion groove and which are adapted to press and fasten said both widthwise lateral end portions of the grip leading and trailing ends of the printing plate against a constraint surface which is a wall surface of said plate insertion groove and with which the grip trailing end of the printing plate is adapted to be in contact in said plate insertion groove, wherein said tap bolt is screwed into a wall tapped hole formed on said constraint surface so as to directly press the printing plate retainer plate in a substantially circumferential direction of the plate cylinder and so as to press and fasten said both widthwise lateral end portions of the grip leading and trailing ends of the printing plate against said constraint surface via said printing plate retainer plate.

2. The printing plate holding apparatus as set forth in claim 1, wherein said plate cylinder further comprises a rotating shaft and a sleeve cylinder removably mounted on the rotating shaft so that the sleeve cylinder can be fitted on, and extracted from, the rotating shaft, and wherein said plate insertion groove is formed on an outer peripheral surface of said sleeve cylinder.

3. The printing plate holding apparatus as set forth in claim 1, wherein said plate insertion groove has a width that is a size in which 0.1 mm to 0.2 mm is added to a sum of thicknesses of said grip leading and trailing ends of the printing plate.

4. The printing plate holding apparatus as set forth in claim 1, wherein said printing plate retainer plate is formed with a tapped hole passing therethrough and having a thread diameter identical to that of said tap bolt, and wherein said tap bolt has a body under its head, said body having an outer diameter smaller than an inner diameter of said tapped hole in the printing plate retainer plate in an interval longer than a plate thickness of said printing plate retainer plate.

* * * * *